US006752177B2

(12) United States Patent
Zenoni et al.

(10) Patent No.: US 6,752,177 B2
(45) Date of Patent: Jun. 22, 2004

(54) SELF-ADJUSTING BRAKING DEVICE FOR WEFT FEEDERS

(75) Inventors: Pietro Zenoni, Leffe (IT); Rosario Castelli, Gandino (IT); Giovanni Pedrini, Leffe (IT)

(73) Assignee: L.G.L. Electronics S.p.A., Gandino (IT)

( * ) Notice: Subject to any disclaimer, the term of this patent is extended or adjusted under 35 U.S.C. 154(b) by 127 days.

(21) Appl. No.: 10/086,687

(22) Filed: Mar. 4, 2002

(65) Prior Publication Data

US 2002/0134872 A1 Sep. 26, 2002

(30) Foreign Application Priority Data

Mar. 20, 2001 (IT) ..... T02001A0026

(51) Int. Cl.[7] ..... D03D 47/36; B65H 51/26
(52) U.S. Cl. ..... 139/452; 66/132; 242/365.4
(58) Field of Search ..... 139/452; 242/365.4, 242/47.01; 66/132

(56) References Cited

U.S. PATENT DOCUMENTS 4,926,912 A * 5/1990 Zenoni ..... 139/452
5,553,641 A * 9/1996 Zenoni ..... 139/452
5,577,536 A * 11/1996 Maina ..... 139/452
6,269,843 B1 * 8/2001 Bertolone ..... 139/452
6,637,692 B1 * 10/2003 Jacobsson ..... 242/365.4

FOREIGN PATENT DOCUMENTS

WO 94 10075 5/1994
WO 99 20557 4/1999

* cited by examiner

*Primary Examiner*—John J. Calvert
*Assistant Examiner*—Robert H. Muromoto, Jr.
(74) *Attorney, Agent, or Firm*—Guido Modiano; Albert Josif; Daniel O'Byrne

(57) ABSTRACT

A self-adjusting braking device for weft feeders, comprising a frustum-shaped braking body that acts on a thread, is suspended elastically in front of the drum of the feeder and is pushed into elastic tangent contact with the drum along an exit circumference of the drum. The braking body has, at a larger-diameter region thereof designed to make contact with the drum, a discontinuous annular contact element, with a plurality of through slits which are arranged so as to be equidistant and delimit a row of contact laminas.

7 Claims, 4 Drawing Sheets

SELF-ADJUSTING BRAKING DEVICE FOR WEFT FEEDERS

BACKGROUND OF THE INVENTION

The present invention relates to a self-adjusting braking device for units for feeding weft to textile machines in general and particularly to weaving looms of the gripper or bullet type.

More specifically, the invention relates to self-adjusting braking devices of the type disclosed in EP-0 536 088 and in Italian patent 1,259,567, referenced hereinafter briefly as conventional devices.

Weft feeders are devices used in weaving processes and typically comprise a fixed cylindrical drum on which an arm that rotates in a fishing-reel fashion winds a plurality of turns of thread that constitute a weft reserve, means for producing the advantage of the turns from the base toward the end of the drum, and braking means for braking at the exit the thread that unwinds from the drum when requested by the loom or the like at each weft insertion and impart thereto the correct mechanical tension, which is indispensable for the correct unwinding of the thread.

The expression "self-adjusting braking devices" is used to designate, in the present description, braking means capable of automatically varying the braking action applied to the thread that unwinds from the drum of the feeder when the advancement speed of the thread varies, in order to keep its mechanical tension substantially constant.

For this purpose, the conventional self-adjusting braking devices are constituted by a substantially frustum-shaped braking body, which is suspended elastically in front of the fixed drum of the feeder, to which it is tangent at an exit circumference that is slightly smaller than the maximum circumference of the drum; the drum, in order to facilitate the unwinding of the thread, has a rounded exit rim whose cylindrical surface is blended with the flat front one.

The thread advances between the drum and the frustum-shaped braking body, onto which it discharges the axial component of its mechanical tension. When the tension rises, as the advancement speed of the thread increases during weft insertion, the axial component tends to displace the braking body in contrast with the elastic action of its suspension means and causes, or tends to cause, its separation from the drum, with a consequent and corresponding decrease in the braking action, which in this manner adjusts itself according to the advancement speed of the thread, keeping its respective mechanical tension substantially unchanged, as mentioned.

For correct operation in the specified sense, the frustum-shaped braking body of the self-adjusting braking devices must have certain characteristics and mainly: considerable radial elasticity, substantial axial rigidity, and limited inertia. For this purpose, it is known to provide the frustum-shaped body by means of a fabric impregnated with resins or with a laminate, providing it internally with a metallic cladding that has a mainly wear-resistant function. The cladding usually covers and protects a limited band of the frustum-shaped body which straddles the exit circumference of the drum of the feeder, and is constituted by a steel lamina of modest thickness, for example between 0.5 and 5 tenths of a millimeter.

It is also known to improve the response of the braking body to variations in thread tension by providing it with a metallic ring that has a raised rim, is arranged at the smaller or end cross-section of the body and is adapted to divert the path of the thread so that the thread discharges onto the braking body the axial component of its tension not only at the region of tangential contact with the drum but also at the end region of the braking body; the arrangement being such as to improve significantly the overall elastic response of the braking device.

However, in some cases, for example in the presence of lower-count threads, such as wool yarns for combed fabrics, the radial elastic yielding of the conventional braking bodies can be insufficient and accordingly the self-adjusting action of the braking applied to the thread by such a braking body can be entirely unsatisfactory. In particular, in conventional braking bodies the presence of the metallic cladding lamina limits significantly, in the very region of contact with the drum, the elastic deformability of the body in a radial direction, since the lamina, which is usually applied and glued directly to the inner face of the body, increases its thickness at the expense of its flexibility. On the other hand, a generalized reduction in the thickness of the material of the frustum-shaped braking body cannot exceed certain limits, on penalty of a consequent unacceptable deterioration of the axial rigidity of the body.

In an attempt to obviate this drawback, it has already been proposed to replace the rigid frustum-shaped body with a metallic body formed by a plurality of independent tongues arranged along the generatrices of a frustum-shaped solid and connected to each other in the region of the maximum circumference of the solid, by means of a band having a continuous surface, which engages, with an elastic tangent contact, the exit portion of the drum of the weft feeder in order to brake the thread, and in which the tongues are free with respect to each other at the region of the solid that has a smaller circumference and where the tongues are partially coupled to a cup for supporting the braking body.

An arrangement of this type, disclosed in WO 94/10075 and WO 94/12420, significantly improves the radial elastic deformability of the braking body but sacrifices almost completely its axial rigidity, compromising unacceptably the self-adjusting operation of the braking system.

According to further conventional embodiments, the portion of the frustum-shaped braking body that is in contact with the drum of the feeder is rendered elastically flexible in a radial direction through the adoption of a spring-loading means interposed between said body and said drum. Embodiments of this type are disclosed in WO 99/20557, wherein such interposed means is constituted by a metallic annular element comprising a plurality of elastically flexible tongues which are connected one another in the region of the braking body that has a larger circumference but are mutually free in the region having a smaller circumference, and in WO 00/20316, wherein said interposed means is constituted by a crown-like disk with a channel-shaped cross-section and provided with a plurality of radial slits.

The main drawback of these further embodiments is the structural complexity of the braking body and essentially the increased dimensions and mass of the body, whose inertia reaches values that are also unacceptable for correct and efficient self-adjusting operation of the braking system.

SUMMARY OF THE INVENTION

The aim of the present invention, starting from the notion of such drawbacks of conventional self-adjusting braking devices, is essentially to eliminate them.

Within this aim, an object of the present invention is to provide a self-adjusting braking device with a braking body that is extremely efficient, has significantly improved characteristics of radial elasticity and axial rigidity and at the same time has a very low inertia, so as to be significantly more effective in terms of the self-adjusting behavior of the braking system. In particular, with the device according to the invention the self-adjusting behavior of the system is enhanced significantly, in that the device needs very low thread tensions in order to modulate the braking action effectively and is thus adapted to operate with any type of thread, especially with lower-count and/or combed threads and even with very high weft insertion speeds, which are typical of modern weaving looms.

Another object of the present invention is to provide a self-adjusting braking device with a frustum-shaped braking body that is structurally very simple, reliable in operation, and economically advantageous.

Another object of the present invention is to provide a self-adjusting braking device with a braking body that has minimal dimensions and requires no stiffening of the respective elastic suspension structure and indeed allows, thanks to its significantly reduced mass, to reduce the elastic rigidity of said structure, further enhancing the sensitivity of the braking system.

According to the present invention, this aim and these and other objects that will become better apparent from the following detailed description are achieved with a self-adjusting braking device having the specific characteristics defined in the appended claims.

Substantially, the invention is based on the inventive concept of providing a braking device with a frustum-shaped braking body that is suspended elastically in front of the drum of the feeder and is pushed into elastic tangent contact with said drum, wherein said braking body is characterized at least by the presence, at a larger-diameter region thereof meant to make contact with said drum, of a discontinuous annular contact element which comprises a plurality of through slits which are arranged so as to be mutually equidistant and delimit a row of contact laminas, each of which has both ends joined to the braking body and monolithic therewith; the annular contact element, arranged at a region of contact between the braking body and the drum, being arranged symmetrically on either side of an exit circumference of said drum.

According to another characteristic of the invention, the slits of the annular contact element are inclined, with respect to the generatrices of the frustum-shaped braking body, so as to be orientated with an angle alpha, preferably a right angle and in any case an angle between 65 and 115°, with respect to the path traced by the unwinding thread directly ahead of the exit circumference of the drum of the feeder. According to the invention, furthermore, the material of the frustum-shaped braking body is chosen from the following group of materials: elastic steel, thermoplastic polymeric material, thermosetting polymeric material, engineering polymer reinforced with carbon fibers, carbon fiber or glass fiber fabrics; and said body can have, in the part below the annular contact element, lightening holes and/or cutouts which are adapted to reduce significantly the mass and therefore the inertia of the braking body.

BRIEF DESCRIPTION OF THE DRAWINGS

Further characteristics and advantages of the self-adjusting braking device according to the present invention will become better apparent from the following detailed description and with reference to the accompanying drawings, given by way of non-limitative example and wherein.

DESCRIPTION OF THE PREFERRED EMBODIMENTS

Figure 1:
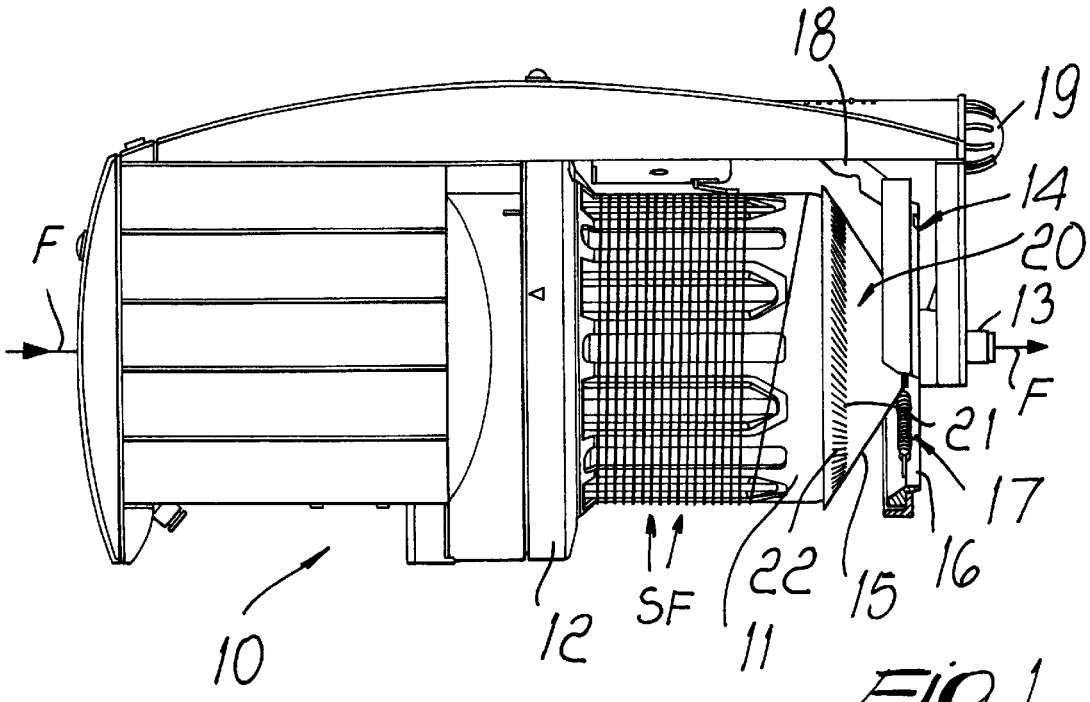
FIG. 1 is a side elevation view of a weft feeder with a self-adjusting braking device according to the present invention.

Initially with reference to FIGS. 1 to 6, the reference numeral 10 designates a conventional weft feeder that comprises a fixed drum 11 on which a hollow arm, rigidly coupled to a rotating disk 12 which is arranged at a base of the drum, winds in a fishing-reel fashion a reserve of weft in the form of a plurality of turns of thread SF. In a per se known manner, the thread F, when requested by the loom (not shown) during weft insertion, unwinds from the drum, passing through a thread guiding element 13 which is coaxial to the drum; during its unwinding motion, the thread is subjected to the action of a self-adjusting braking device, generally designated by the reference numeral 14. Such device is designed to keep the thread tensioned by modulating automatically the braking action, in order to generate a constant or substantially constant tension on the thread, when the advancement speed of the thread varies during the insertion step.

For this purpose, the device 14, interposed between the drum 11 and the thread guiding element 13, comprises a frustum-shaped braking body 15, which is arranged so as to face the drum 11, to which it is tangent along an exit circumference CU which is slightly smaller than the maximum circumference of the drum. By means of an annular support 16 and an elastic suspension 17, the braking body 15 is pushed into elastic contact engagement with the drum 11 in order to brake, with a preset elastic pressure (so-called static pressure), the thread that unwinds from the drum. The elastic tangent contact between the braking body 15 and the drum 11 occurs along the exit path CU, and the annular support 16 is supported by a carriage 18, which can be moved axially with respect to the drum 11 by means of a screw mechanism 19 in order to vary the static pressure that pushes the body 15 against the drum.

Figure 6:
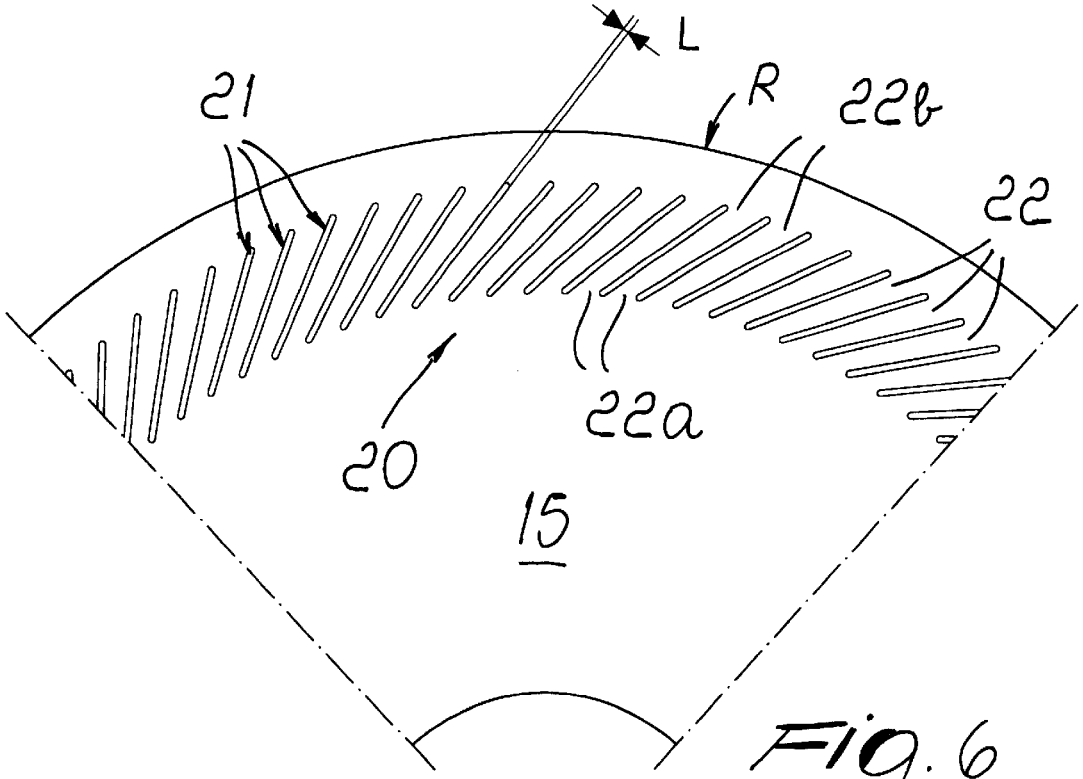
FIG. 6 is a highly enlarged view of a detail of FIG. 5.
Figure 2:
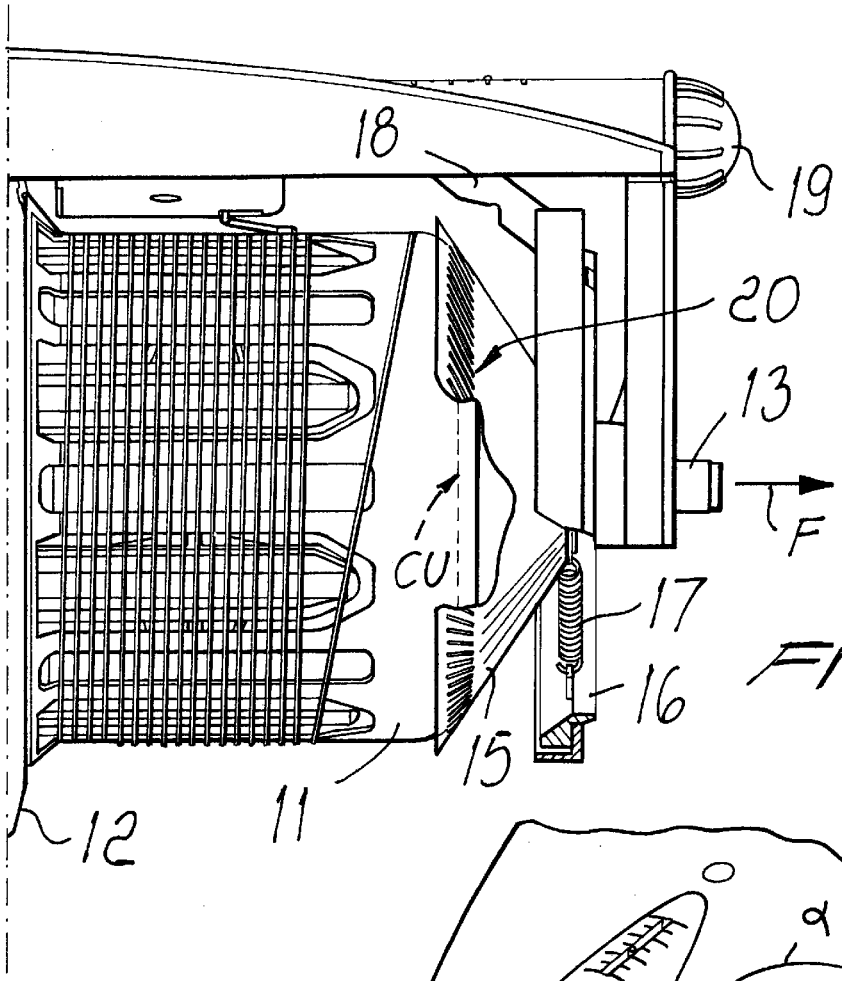
FIG. 2 is a partially sectional enlarged-scale view of a detail of the front part of the feeder of FIG. 1.
Figure 3:
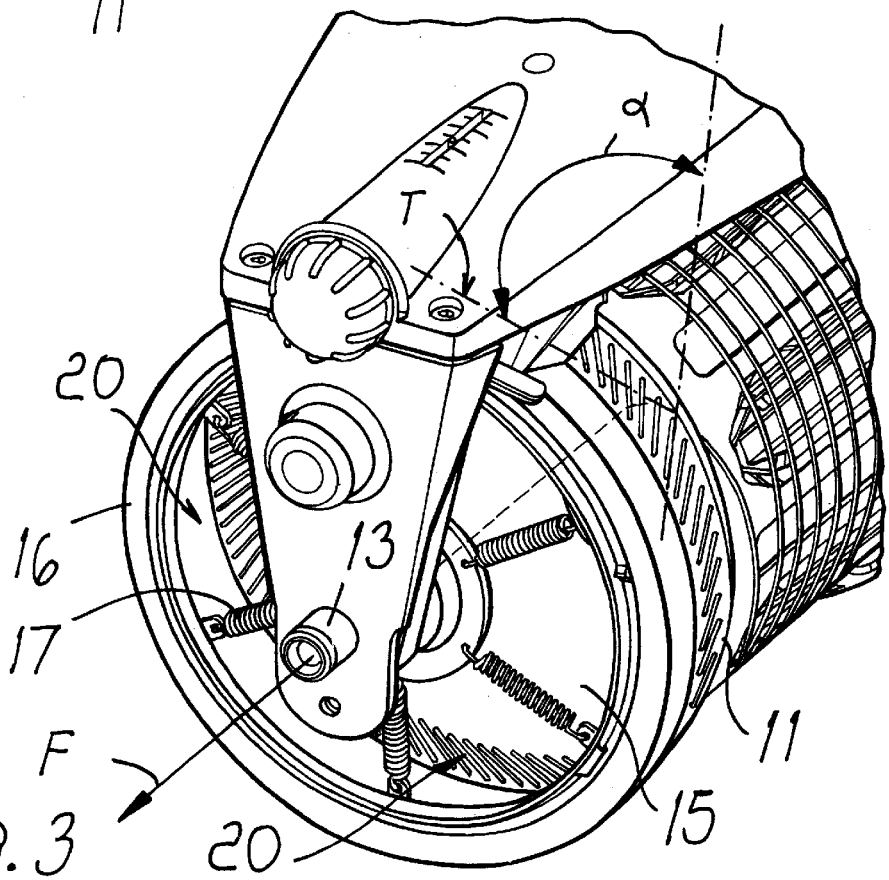
FIG. 3 is a partial perspective view of the same front part of the feeder of FIG. 1.
Figure 4:
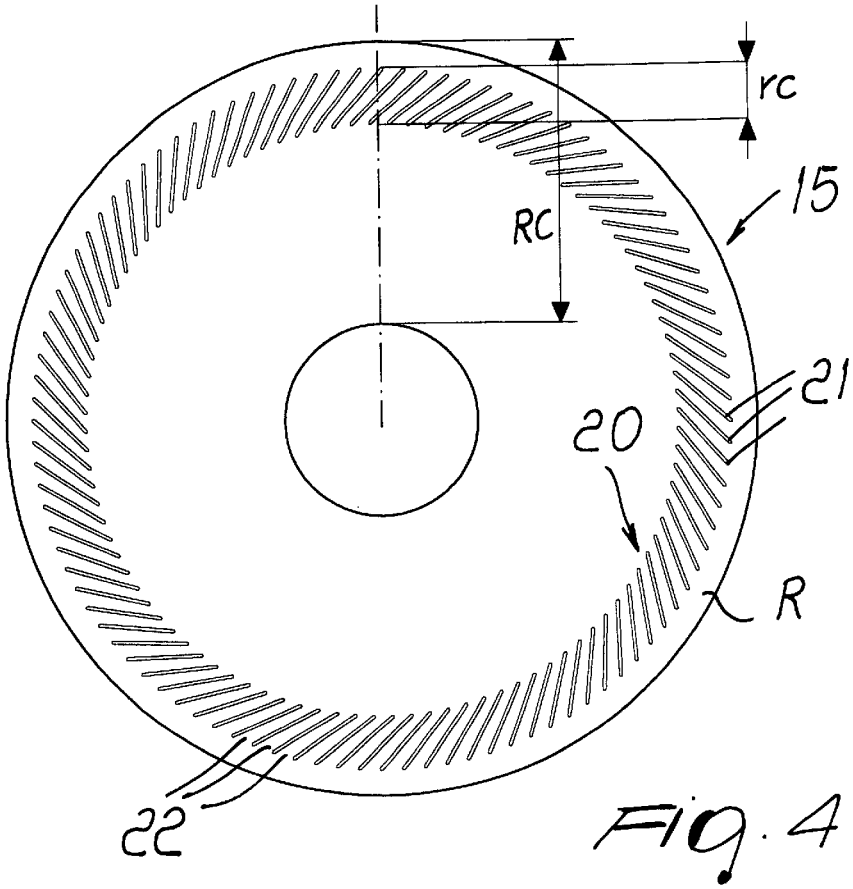
FIG. 4 is a plan view of the frustum-shaped braking body of the self-adjusting braking device of FIG. 1, according to a preferred embodiment of the invention.
Figure 5:
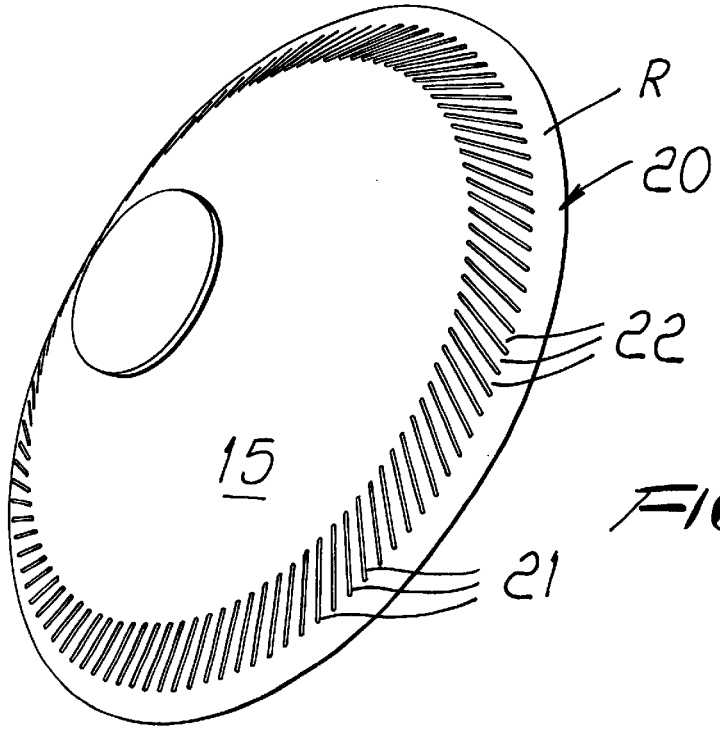
FIG. 5 is a perspective view of the braking body of FIG. 4.

According to the present invention, the braking body 15 has, at its larger-diameter region R designed to make contact with the drum 11, a discontinuous annular contact element 20, which comprises a plurality of through slits 21 which are equidistant and delimit a row of contact laminas 22, each of which has both ends 22*a* and 22*b* joined to the braking body 15 and monolithic therewith (FIG. 6). The annular contact element 20, arranged at the region where the braking body makes contact with the drum, is preferably arranged symmetrically on either side of the exit circumference CU of the drum, and the ratio between its radial extension rc and the radial extension RC of the braking body 15 (FIG. 6) is typically between 0.15 and 0.60; these values are matched by a rising radial elasticity of the individual contact laminas 22, while the gap L of the through slits 21 is typically between 2 and 12 tenths of a millimeter and is directly proportional to the count of the thread to be handled. According to the invention, furthermore, the through slits 21 of the annular contact element 20 are inclined, with respect to the generatrices of the frustum-shaped braking body 15, so as to be orientated at an angle alpha, between 65 and 115° and preferably a right angle, with respect to the path T that the unwinding thread F assumes directly ahead of said exit circumference CU of the drum 11 of the feeder (FIG. 3).

The frustum-shaped braking body 15 as described above is typically made of elastic steel with a thickness between 0.05 and 0.3 millimeters, but although such material is the preferred one for the production of the body, the body can be more generally made of one of the materials chosen in the following group: elastic steel, thermoplastic polymeric material, thermosetting polymeric material, engineering polymer reinforced with is carbon fibers, carbon fiber or glass fiber fabrics.

Figure 7:
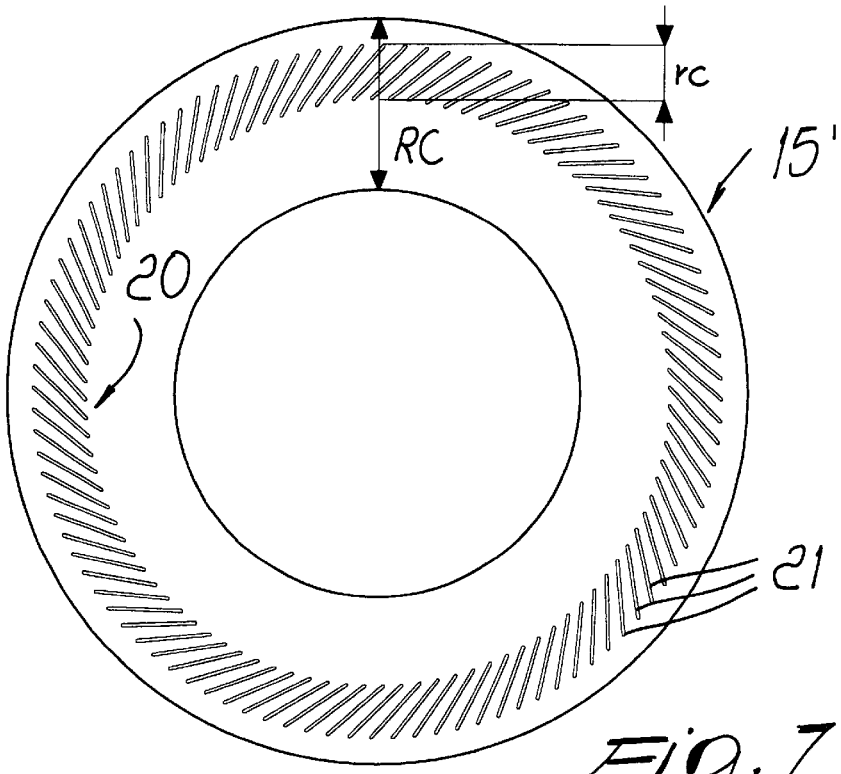
FIG. 7 is a plan view of the braking body according to a second embodiment of the invention.

The embodiment of FIG. 7 differs from what has been described above in that in the braking body 15' illustrated therein the rc/RC ratio assumes a high value, equal to approximately 0.30, essentially in order to reduce the mass, and therefore the inertia, of the braking body 15' to the benefit of more rapid response, in terms of modulation, of the braking system.

Figure 8:
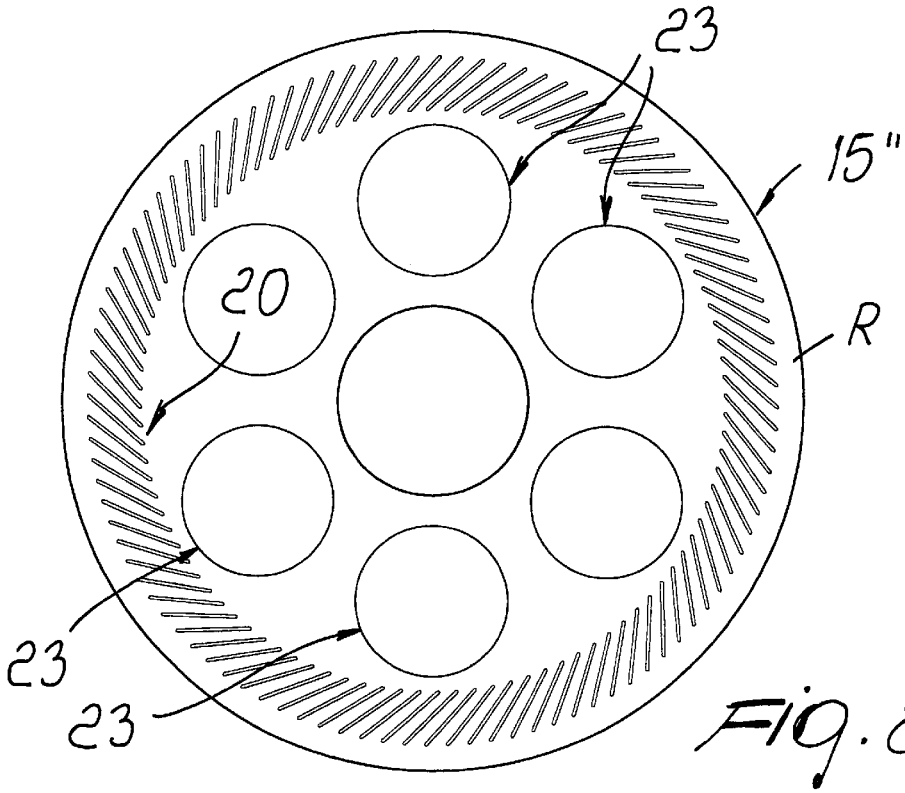
FIG. 8 is a plan view of the braking body according to a third embodiment of the invention.

The same result is obtained with the braking body 15" of the embodiment of FIG. 8; such body, in order to reduce significantly its mass and inertia, has lightening holes and/or cutouts 23 located in the region below the annular contact element 20.

Without altering the concept of the invention, the details of execution and the embodiments may of course be changed extensively with respect to what has been described and illustrated by way of non-limitative example without thereby abandoning the scope of protection of the appended claims.

The disclosures in Italian Patent Application No. TO2001A000260 from which this application claims priority are incorporated herein by reference.

What is claimed is:

1. A self-adjusting braking device for units for feeding weft thread, having a frustum-shaped braking body that acts on said thread and is suspended elastically in front of (the) a drum of (the) a feeder and is pushed into elastic tangent contact with said drum along an exit circumference of said drum, wherein said braking body has, at a larger-diameter region thereof meant to make contact with the drum, a discontinuous annular contact element, which comprises a plurality of through slits which are arranged so as to be equidistant and delimit a row of contact laminas, each of which has both ends joined to the braking body and monolithic therewith; the annular contact element, arranged at a region of contact between the braking body and the drum, being ranged symmetrically on either side of said exit circumference of said drum.

2. The braking device according to claim 1, wherein the through slits of said annular contact element are inclined, with respect to generatrices of the frustum-shaped braking body, so as to be orientated at an angle between 65 and 115° with respect to a path traced by the unwinding thread directly ahead of said exit circumference of the drum of the feeder.

3. The braking device according to claim 1, wherein a ratio between the radial extension of the annular contact element and the radial extension of the braking body has values between 0.15 and 0.60; and wherein said values are matched by an increasing radial elasticity of the individual contact laminas separated by said through slits of the annular contact element.

4. The braking device according to claim 1, wherein said through slits of said annular contact element have a gap between 2 and 12 tenths of a millimeter and directly proportional to a count of the thread to be handled.

5. The braking device according to claim 1, wherein the braking body has lightening holes and/or cutouts located in a part below the annular contact element.

6. The braking device according to claim 1, wherein said frustrum-shaped braking body is made of one of the materials chosen in the following group: elastic steel, thermoplastic polymeric material, thermosetting polymeric material, engineering polymer reinforced with carbon fibers, carbon fiber or glass fiber fabrics.

7. The braking device according to claim 6, wherein said frustrum-shaped braking body is made of elastic steel with a thickness typically between 0.05 and 0.3 millimeters.

* * * * *